US009349375B2

(12) United States Patent
Taniguchi et al.

(10) Patent No.: US 9,349,375 B2
(45) Date of Patent: May 24, 2016

(54) APPARATUS, METHOD, AND COMPUTER PROGRAM PRODUCT FOR SEPARATING TIME SERIES SIGNALS

(71) Applicants: KABUSHIKI KAISHA TOSHIBA, Minato-ku, Tokyo (JP); INTER-UNIVERSITY RESEARCH INSTITUTE CORPORATION, RESEARCH ORGANIZATION OF INFORMATION AND SYSTEMS, Tachikawa-shi, Tokyo (JP)

(72) Inventors: Toru Taniguchi, Kanagawa (JP); Nobutaka Ono, Tokyo (JP)

(73) Assignees: Inter-University Research Institute Corporation, Research Organization of Information and Systems, Tokyo (JP); KABUSHIKI KAISHA TOSHIBA, Tokyo (JP)

( * ) Notice: Subject to any disclaimer, the term of this patent is extended or adjusted under 35 U.S.C. 154(b) by 185 days.

(21) Appl. No.: 13/967,623

(22) Filed: Aug. 15, 2013

(65) Prior Publication Data

US 2014/0058736 A1 Feb. 27, 2014

(30) Foreign Application Priority Data

Aug. 23, 2012 (JP) ..... 2012-184552

(51) Int. Cl.
*G10L 19/00* (2013.01)
*G10L 19/008* (2013.01)
*G10L 21/0272* (2013.01)

(52) U.S. Cl.
CPC ..... *G10L 19/00* (2013.01); *G10L 19/008* (2013.01); *G10L 21/0272* (2013.01)

(58) Field of Classification Search
CPC ..... G10L 19/008
USPC ..... 704/500; 381/10
See application file for complete search history.

(56) References Cited

U.S. PATENT DOCUMENTS 6,526,148 B1 * 2/2003 Jourjine et al. ..... 381/94.7
6,622,117 B2 * 9/2003 Deligne et al. ..... 702/190

(Continued)

FOREIGN PATENT DOCUMENTS

JP 2006-238409 9/2006
JP 2011-175114 9/2011

OTHER PUBLICATIONS

Ono, Nobutaka, and Shigeki Miyabe. "Auxiliary-function-based independent component analysis for super-Gaussian sources." Latent Variable Analysis and Signal Separation. Springer Berlin Heidelberg, 2010. 165-172.*

(Continued)

*Primary Examiner* — Shaun Roberts
(74) *Attorney, Agent, or Firm* — Amin, Turocy & Watson LLP; Gregory Turocy

(57) ABSTRACT

According to an embodiment, a signal processing apparatus includes an estimation unit and an updating unit. The estimation unit is configured to estimate an auxiliary variable of a target section including first and second sections of input signals by using an approximating auxiliary function for approximating an auxiliary function having an auxiliary variable as an argument. The auxiliary function is determined according to an objective function that outputs a function value that is smaller as a statistical independence of separated signals into which input signals in time-series are separated by a demixing matrix is higher. The estimation unit is configured to estimate a value of the auxiliary variable of the target section based on the estimated auxiliary variable. The updating unit is configured to update the demixing matrix such that a function value of the approximating auxiliary function is minimized.

13 Claims, 4 Drawing Sheets

(56) References Cited

U.S. PATENT DOCUMENTS

| | | | | |
|---|---|---|---|---|
| 6,654,719 | B1 * | 11/2003 | Papadias | 704/233 |
| 8,521,477 | B2 * | 8/2013 | Nam | 702/196 |
| 8,874,439 | B2 * | 10/2014 | Kim et al. | 704/233 |
| 2001/0037195 | A1 * | 11/2001 | Acero et al. | 704/200 |
| 2006/0206315 | A1 | 9/2006 | Hiroe et al. | |
| 2009/0306973 | A1 * | 12/2009 | Hiekata et al. | G10L 21/028 704/205 |

OTHER PUBLICATIONS

Ono, Stable and Fast Update Rules for Independent Vector Analysis Based on Auxiliary Function Technique, Proc. IEEE WASPAA, 2011.

Kim, Real-Time Independent Vector Analysis for Convolutive Blind Source Separation, IEEE Transactions on Circuits and Systems, Regular Papers, vol. 57, No. 7, Jul. 2010.

* cited by examiner

APPARATUS, METHOD, AND COMPUTER PROGRAM PRODUCT FOR SEPARATING TIME SERIES SIGNALS

CROSS-REFERENCE TO RELATED APPLICATION

This application is based upon and claims the benefit of priority from Japanese Patent Application No. 2012-184552, filed on Aug. 23, 2012; the entire contents of which are incorporated herein by reference.

FIELD

Embodiments described herein relate generally to a signal processing apparatus, a signal processing method and a computer program product.

BACKGROUND

Conventionally, techniques of separating time series signals have been studied, with a focus on sound source separation for separating, for each sound source, acoustic signals such as voice coming from a plurality of sound sources and observed by a plurality of microphones. Among the techniques, a method that uses independent component analysis has been actively studied as a technique for so-called blind sound source separation which needs no prior information such as sound source directions.

Signal separation according to the independent component analysis is a technique of separating signals for each signal source under the assumption that acoustic signals coming from the signal sources are mutually statistically independent. The independent component analysis may be formulated as an optimization problem for obtaining parameters of a demixing matrix used for separation of signals based on a criterion for maximizing statistical independence of signals separated by the demixing matrix. However, the solution is not analytically obtained, and the demixing matrix parameters have to be repeatedly updated for a sequential optimization method such as a gradient method. Thus, there is a problem that the amount of calculation for obtaining sufficient signal separation accuracy is increased. Also, to obtain a solution with high accuracy and with a small amount of calculation, a parameter called step size that is used in repetitive calculation has to be appropriately adjusted in advance by hand or by an observation signal.

On the other hand, there is proposed an auxiliary function method which achieves, by using an auxiliary function set under a certain condition for an objective function of the optimization problem, stable separation accuracy with a smaller amount of calculation compared to a natural gradient method while requiring no parameter setting such as the step size. Also, an auxiliary function method is being proposed of performing independent vector analysis which does not require post-processing called permutation, which is necessary in sound source separation by the independent component analysis.

However, with the conventional techniques, it is not possible to perform the blind sound source separation process in real time while coping with changes in the environment such as movement or emergence of a sound source.

DETAILED DESCRIPTION

Figure 1:
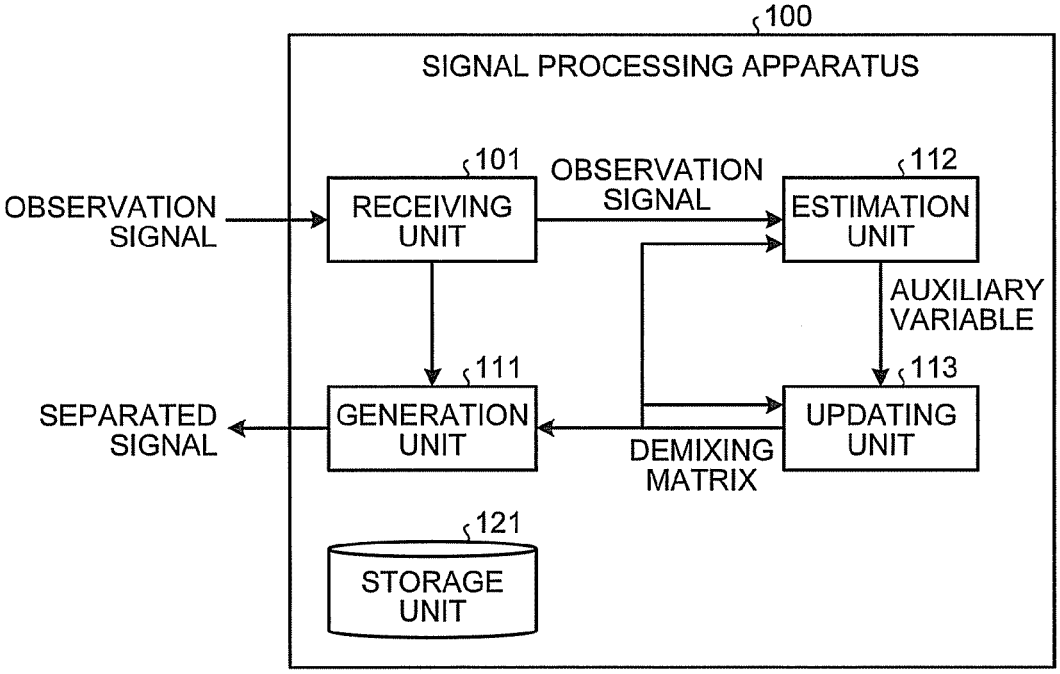
FIG. 1 is a block diagram illustrating a signal processing apparatus of a present embodiment.

According to an embodiment, a signal processing apparatus includes an estimation unit, an updating unit, and a generation unit. The estimation unit is configured to estimate an auxiliary variable of a processing target section including a first section of an input signal where a time length is not zero and a second section different from the first section by using an approximating auxiliary function for approximating an auxiliary function which has an auxiliary variable as an argument. The auxiliary function is determined according to an objective function that outputs a function value that is smaller as a statistical independence of a plurality of separated signals into which a plurality of input signals in time-series are separated by a demixing matrix is higher. The auxiliary function is capable of calculating the demixing matrix that reduces a function value of the objective function by alternately performing minimization of a function value regarding the auxiliary variable and minimization of a function value regarding the demixing matrix. The estimation unit is configured to estimate a value of the auxiliary variable of the processing target section based on the auxiliary variable estimated for the input signal in the first section and the input signal in the second section. The updating unit is configured to update the demixing matrix such that a function value of the approximating auxiliary function is minimized based on the value of the estimated auxiliary variable and the demixing matrix. The generation unit is configured to generate the separated signals by separating the input signals using the updated demixing matrix.

Hereinafter, a preferred embodiment of a signal processing apparatus according to the invention will be described in detail with reference to the appended drawings.

To perform a blind sound source separation process in real time, so-called online processing of updating a demixing matrix at every specific time point using observation signals of the past up to the time point, and separating the signal at the time point using the updated demixing matrix is performed. Here, to maintain the delay time of output of a separated signal to be less than a specific time at all times, that is, to perform real-time processing, calculation time for each update has to be made shorter than the update time interval such that the delay time is not accumulated. On the other hand, to follow changes in the environment in a short time, the update time interval is desirably as short as possible.

At the time of performing sound source separation by a sound source separation method using the independent component analysis, every time a demixing matrix is updated, all the observation signals which are the target of separation are referred to. Accordingly, to perform online a sound source separation process by the method, observation signals of a predetermined length from the past up to a certain time point may be saved, and the demixing matrix may be updated with reference to the saved signals. However, as the observation signals to be referred to become long, the amount of calculation at each update is increased. On the other hand, if the referenced observation signals are made short, the amount of calculation is reduced, but the separation accuracy or the stability may be impaired.

A signal processing apparatus according to the present embodiment separates observation signals using the auxiliary function method. Then, the signal processing apparatus according to the present embodiment estimates an auxiliary variable that is to be used at the time of updating a demixing matrix in a section (a first section) from an auxiliary variable estimated with respect to an observation signal in a section different from the first section (a second section) and a time-series signal in the first section. This makes it unnecessary to refer to all the observation signals of a predetermined time length at each time point in the online processing. That is, increase in the amount of calculation for each update in the case of realizing the online processing of the sound source separation process can be avoided.

The present embodiment is applicable to separation of general time-series signals, such as electroencephalographic signals or radio signals, from which a plurality of observations may be obtained. In the following embodiment, separation of acoustic signals will be described as an example.

It is assumed that currently there are K numbers of non-moving sound sources within a space, and signals from the sound sources are observed at M numbers of observation points. The relationship between a sound source signal and an observation signal may be expressed by the following Equation (1) using respective signals s(ω,t) and x(ω,t) in time-frequency representation and an M×K-dimensional time-invariant spatial transfer characteristic matrix A(ω).

$$x(\omega,t)=A(\omega)s(\omega,t)+n(\omega,t) \tag{1}$$

The s(ω,t) and x(ω,t) are each a K-dimensional or M-dimensional complex vertical vector. The ω is a frequency bin number. The t is a time point. A signal in the time-frequency representation is calculated, for example, from a corresponding time-series signal using short-time Fourier transform (STFT). The n(ω,t) represents a noise such as an error, an ambient noise, or the like, that occurs at the time of representing the time-series signal in the time-frequency representation.

Accordingly, to obtain an estimated signal (a separated signal) y(ω,t) with respect to which a sound source signal is estimated from x(ω,t), an appropriate value is determined for an K×M-dimensional demixing matrix W(ω) in the following Equation (2).

$$y(\omega,t)=W(\omega)x(\omega,t) \tag{2}$$

If the spatial transfer characteristic matrix A(ω) is known, an appropriate W(ω) may be easily set by calculating the pseudo-inverse matrix. However, in actual application, it is difficult to obtain A(ω) in advance. The problem of the blind sound source separation is to obtain the demixing matrix W(ω) in a case information regarding A(ω) is not obtained in advance.

Additionally, in the following explanation, each element of s(ω,t), x(ω,t), y(ω,t) and W(ω) is expressed by the following Equation (3). Moreover, T indicates a transpose of the matrix, and H indicates a complex conjugate transpose of the matrix.

$$s(\omega,t)=[s_1(\omega,t),s_2(\omega,t),\ldots,s_K(\omega,t)]^T$$

$$x(\omega,t)=[x_1(\omega,t),x_2(\omega,t),\ldots,x_M(\omega,t)]^T$$

$$y(\omega,t)=[y_1(\omega,t),y_2(\omega,t),\ldots,y_K(\omega,t)]^T$$

$$W(\omega)=[w_1(\omega),w_2(\omega),\ldots,w_K(\omega)]^H \tag{3}$$

The present embodiment describes separation of acoustic signals in the time-frequency representation, but signals to which the present embodiment may be applied are not limited to such. As long as observation signals in a plurality of time-series may be modeled in the manner of Equation (1) in such a way that a noise is added to the product of matrices of a plurality of signal sources, application to any time-series signal is possible. For example, application to separation of acoustic signals which have been instantaneously mixed is also possible.

With the blind sound source separation according to the independent component analysis, sound source separation is realized by optimizing the demixing matrix by the criterion that the statistical independence of the separated signals is maximized in the case the number of sound sources K is equal to or less than the number of observations M. For the sake of simplicity of explanation, a case where K is equal to M will be described below. In the case K is less than M, the number of observation signals may be reduced to K in advance using principal component analysis or the like. As a result, the independent component analysis may be formulated as a problem of minimizing an objective function J(W(ω)) indicated in the following Equation (4).

$$J(W(\omega))=\sum_{k=1}^{K}E[G(y_k(\omega))]-\log|\det W(\omega)| \tag{4}$$

Here, the E[•] is an expectation with respect to a time point t. Also, the G(•) is a function illustrated below as Equation (5) that uses a probability density function q(•) of a sound source.

$$G(y_k(\omega))=-\log q(y_k(\omega) \tag{5}$$

It is known that, as the probability density function q(•), a super-Gaussian or sub-Gaussian distribution, other than a normal distribution, may be used. For example, the super-Gaussian distribution is generally used in the case the sound source is voice of a person.

With the independent component analysis of Equation (4), sound source separation is separately performed for each frequency. Accordingly, generally, it is not clear to which sound source a signal in a separate channel in a band corresponds. Thus, post-processing called permutation for grouping signals in separate channels into signals from the same sound source has to be performed. In contrast, there is a proposed method called independent vector analysis which requires no permutation. The independent vector analysis is a problem of minimizing an objective function J(W) illustrated in the following Equation (6).

$$J(W)=\sum_{k=1}^{K}E[G(y_k)]-\sum_{\omega=1}^{N_\omega}\log|\det W(\omega)| \tag{6}$$

In the independent vector analysis, separated signal vectors $y_k$ in all the frequencies and G(•) corresponding to a multi-dimensional probability density function q(•) are used instead of the separated signal $y_k(\omega)$ in each frequency illustrated in Equation (4). Accordingly, the independence among separate channels may be maximized while maintaining consistency of sound source over frequencies for the same separate channel. That is, the post-processing, i.e. the permutation, becomes unnecessary.

Here, the W indicates the collection of all the frequencies of W(ω), and the $N_\omega$ indicates the upper limit of the frequency. The separated signal vector $y_k$ is expressed by the following Equation (7).

$$y_k=[y_k(1),y_k(2),\ldots,y_k(N_\omega)]^T \tag{7}$$

Conventionally, the minimization problems of Equation (4) and Equation (6) are solved by gradient methods such as a natural gradient method. According to the gradient methods, as indicated by the following Expression (8), the objective function is minimized by sequentially updating the W using the amount of modification ΔW of the demixing matrix W calculated by a certain method.

$$W \leftarrow W + \eta \Delta W \tag{8}$$

Here, the η is a positive real number called step size. If the value of the η is set to an appropriate size, W that minimizes the objective function by the update described above may be obtained. However, generally, it is difficult to set an appropriate value in advance. Also, if the step size is too large, convergence to the optimal solution is not achieved, and if, on the contrary, the step size is too small, convergence is slowed.

Accordingly, there is a proposed method of obtaining optimal solutions for Equation (4) and Equation (6) stably and quickly by applying an auxiliary function method, instead of the gradient methods, for each of the independent component analysis and the independent vector analysis. In the following, a case of the independent vector analysis where the objective function is Equation (6) will be described. Equation (4) may be optimized in the same manner in the case of the independent component analysis.

The auxiliary function method is an optimization method of obtaining W that makes an objective function J(W) smaller by setting an auxiliary function Q(W,V) including an auxiliary variable V, where $J(W) \leq Q(W,V)$ and $J(W) = \min_V Q(W, V)$, and alternately and repetitively performing minimization of the following Equation (9) and Equation (10).

$$V^{(n+1)} = \underset{V}{\operatorname{argmin}}\ Q(W^{(n)}, V) \tag{9}$$

$$W^{(n+1)} = \underset{W}{\operatorname{argmin}}\ Q(W, V^{(n+1)}) \tag{10}$$

It is guaranteed that the objective function J(W) is monotonically decreased by the repetition of Equation (9) and Equation (10). Thus, convergence is more rapid compared to the gradient methods where convergence is not guaranteed, and a stable solution may be obtained. To apply the auxiliary function method, an auxiliary function capable of executing Equation (9) and Equation (10) has to be found and set with respect to the objective function.

For example, the auxiliary function method may be applied to the independent vector analysis if the auxiliary function Q(W,V) is set as the following Equation (11).

$$Q(W, V) = \frac{1}{2}\sum_{\omega=1}^{N_\omega}\sum_{k=1}^{K} w_k^H(\omega)V_k(\omega)w_k(\omega) - \sum_{\omega=1}^{N_\omega}\log|\det W(\omega)| \tag{11}$$

Note that the $V_k(\omega)$ is one element of the auxiliary variable V, and is defined as the following Equation (12).

$$V_k(\omega) = E\left[\frac{G'_R(r_k^{(t)})}{r_k^{(t)}}x(\omega, t)x^H(\omega, t)\right] \tag{12}$$

The $G'_R(r)/r$ is defined as a function that is continuous with respect to a real number r of 0 or more, and that is monotonically decreased. The $G'_R(r)$ is a function obtained by differentiating the $G_R(r)$ by the r. The $G_R(r)$ is related to the probability density function of a sound source of Equation (5) based on the definition of $G(|y_k|)=G_R(r)$. Based on the definition of $G'_R(r)/r$, optimization using the auxiliary functions of Equation (11) and Equation (12) means performing sound source separation while assuming that the sound source has super-Gaussian characteristics, and is suitable for separation of voice of a person. For example, a function $G_R(r)=r$ may be used, but any function may be used as long as the conditions of the definitions above are satisfied.

When using the auxiliary functions defined by Equation (11) and Equation (12), minimization of Equation (9) may be performed by substituting the following Equation (13) into Equation (12).

$$r_k^{(t)} = \sqrt{\sum_{\omega=1}^{N_\omega}|W_k^H(\omega)x(\omega, t)|^2} \tag{13}$$

Also, minimization of Equation (10) may be performed by updating $W_k(\omega)$ in the manner of the following Expression (14).

$$w_k(\omega) \leftarrow (W(\omega)V_k(\omega))^{-1}e_k$$

$$w_k(\omega) \leftarrow w_k(\omega)/\sqrt{w_k^H(\omega)V_k(\omega)w_k(\omega)} \tag{14}$$

Here, the $e_k$ is a K-dimensional vertical vector where only the k-th element is one, and the remaining elements are zero.

Here, in reality, an expectation of Equation (12) is obtained by time averaging in the manner of the following Equation (15).

$$V_k(\omega) = \frac{1}{N_t}\sum_{t=1}^{N_t}\left[\frac{G'_R(r_k^{(t)})}{r_k^{(t)}}x(\omega, t)x^H(\omega, t)\right] \tag{15}$$

The $N_t$ is a positive integer, and is a time length of an observation signal. When the time average is calculated over a range from a time point in the past $\tau-N_t+1$ to the present time point τ in the manner of the following Equation (16), online processing may be realized.

$$V_k(\omega, \tau) = \frac{1}{N_t}\sum_{t=\tau-N_t+1}^{\tau}\left[\frac{G'_R(r_k^{(t)})}{r_k^{(t)}}x(\omega, t)x^H(\omega, t)\right] \tag{16}$$

Since Equation (13) includes the $w_k$, Equation (16) has to be calculated every time the demixing matrix is updated. In the online processing, the $w_k$ is updated at each time point, and thus, $G'_R(r_k^{(t)})/r_k^{(t)}$ in Equation (16) has to be calculated $KN_t$ times for each update. Accordingly, the amount of calculation at each time point is extremely large.

Here, it may seem possible to reduce the amount of calculation by making the $N_t$ small. However, in an extreme case where the $N_t$ is equal to one, for example, the regularity of the $V_k(\omega)$ is lost, and an inverse matrix is not calculated by Expression (14). Also, even if the calculation is possible, the obtained demixing matrix may overfit the signal in a short section, and the separation accuracy may be reduced as a result. Similarly, the method of updating the demixing matrix using an observation signal at one time point is conceivable with respect to a method that uses the gradient methods, but this method has a similar defect.

Accordingly, with the present embodiment, approximation is performed such that an auxiliary variable $V_k(\tau)$ at a time point $\tau$ is sequentially calculated based on an auxiliary variable $V_k(\tau-1)$ at a previous time point $\tau-1$ in the manner of the following Equation (17), instead of Equation (16).

$$V_k(\omega, \tau) = \alpha V_k(\omega, \tau - 1) + (1 - \alpha)\frac{G'_R(r_k(\tau))}{r_k(\tau)}x(\omega, \tau)x^H(\omega, \tau) \quad (17)$$

The $\alpha$ is a forgetting factor of a real number between zero and one. The smaller the value of the forgetting factor $\alpha$, the less influence the past observation has. Additionally, the $r_k(\tau)$ is expressed by the following Equation (18).

$$r_k(\tau) = \sqrt{\sum_{\omega=1}^{N_\omega} |\tilde{w}_k^H(\omega)x(\omega, \tau)|^2} \quad (18)$$

The $r_k^{(t)}$ in Equation (13) is also calculated for each time point, and thus, what is meant by Equation (18) and Equation (13) is the same.

By approximating Equation (16) in the manner of Equation (17), the amount of calculation per one update may be drastically reduced. In Equation (17), an observation signal of one time point is directly used in calculation, and thus, the $G'_R(r_k(\tau))/r_k(\tau)$ has to be calculated only K times. Of course, the right-hand side of Equation (17) may be modified to calculate the $G'_R(r_k(\tau))/r_k(\tau)$ retrospectively to a certain extent.

Also, it is possible to follow a change in the environment such as movement of a sound source by using approximation of the auxiliary variable in Equation (17). Equation (17) may be interpreted as calculating the $V_k(\omega)$ while placing a greater weight on the observation in the recent past by the forgetting factor $\alpha$. Moreover, the same weight is placed on the past demixing matrix referred to in the $G'_R(r_k(\tau))$ and a separated signal obtained by the past demixing matrix. Accordingly, separated signals at the time of start of processing and before the change in the environment will be considered less and less, and the influence at the current time point of the estimation error of the past demixing matrix and the change in the environment may be reduced.

Due to the approximation of Equation (17), minimization of the auxiliary function Q(W,V) regarding the V in Equation (9) is not performed. Thus, theoretical convergence of the objective function J(W) is not strictly guaranteed. However, in reality, the auxiliary variable $V_k$ may be estimated sufficiently accurately by this approximation. This is because Equation (16) may be interpreted as a weighted covariance of the signal $x(\omega,t)$, and Equation (17) corresponds to approximation of the weighting factor by the $\alpha$ and the $w_k$ for each time point in the past. When assuming that the $w_k$ nears the desirable demixing matrix as time passes, it makes sense to place a great weight on the recent past that is reliable using $\alpha$. Additionally, it is experimentally confirmed that it is possible to calculate a demixing matrix that realizes sufficient separation accuracy by the $V_k$ estimated. Accordingly, as described above, in the actual application, there is a great merit with respect to the amount of calculation or the following capability for a change in the environment.

Heretofore, approximation of the $V_k(\tau)$ is realized in the form of a weighted sum with the $V_k(\tau-1)$ at an immediately preceding time point. The time point to be used in the calculation is not limited to the immediately preceding time point, and any time point may be used as long as the $V_k$ is calculated and usable. For example, if, in the case all the observation signals are obtained in advance or in the case delay of a several time points is allowed in the separation process, the immediately following $V_k$ may be used without being limited to the immediately preceding time point, the $V_k$ at the current time point may be more accurately predicted. Also, in the case the position of the sound source may be estimated to a certain degree from another type of signal such as an image at the time of sound source separation, the $V_k$ of the past when the sound source was at a position near the position at the current time point may also be used. Furthermore, the weighted sum of a plurality of $V_k$ of the past, or a general one-variable function or a multi-variable function other than the weighted sum may also be used. Furthermore, as the observation signal to be used in Equation (17), besides the signal at the current time point $\tau$, signals from several of past time points including the signal at the current time point may be used. When summarizing the above, Equation (17) may be generalized as the following Equation (19).

$$V_k(\tau) = f^{(\beta)}(\tilde{V}_k(\tau), V_k(\tau - N_t), V_k(\tau - N_t - 1), \ldots) \quad (19)$$

$$\tilde{V}_k(\tau) = \frac{1}{N_t}\sum_{t=\tau-N_t+1}^{\tau} \frac{G'_R(r_k(t))}{r_k(t)}x(\omega, t)x^H(\omega, t)$$

Here, the $f(\beta)(\ldots)$ is a multi-variable function, and the $\beta$ is a shape parameter that controls the shape of the function. If the $N_t$ is increased or the $f(\beta)(\ldots)$ is made a non-linear function or the number of arguments is increased, the amount of calculation becomes large but the $V_k$ may be accurately approximated.

An estimation unit 112 may change the estimation method for the auxiliary variable according to attribute information indicating the attribute of an observation signal. Also, an updating unit 113 may change the update method for the demixing matrix according to the attribute information. The attribute information is information indicating the position of a sound source, an energy value of the observation signal, and the like, for example.

For example, the forgetting factor $\alpha$ in Equation (17) and $\beta$ in Equation (19) are not fixed values, and they may be dynamically changed according to the state of the observation signal or the sound source. That is, in the case movement of a sound source may be detected using an image sensor or the like, the value of the forgetting factor $\alpha$ may be changed according to the state of movement of the sound source. For example, in the case the sound source is moved, the $V_k$ before movement is considered not helpful in estimating the current $V_k$, and thus, the forgetting factor $\alpha$ in Equation (17) is made small. This enables estimation where weight is greater for the observations of the recent past or at the current time point, and the demixing matrix may swiftly follow the movement of the sound source.

Furthermore, the demixing matrix for one time point may be updated any number of times. For example, a method may be used according to which the number of times of update at one time point is great at the start of the signal separation process, and then, the number of times of update is reduced after several time points. Accordingly, the aim at the time of start is to quickly become close to the optimal demixing matrix, and after several time points, it would be safe to assume that the demixing matrix has converted to a certain degree, and the amount of calculation may be reduced.

Moreover, a configuration is also possible where the update is stopped when the value of the demixing matrix, the function value of the objective function or the amount of change (the amount of update) of the function value of the auxiliary function at the time of update of the demixing matrix becomes smaller than a predetermined threshold value. If the energy value of the observation signal is small, it is assumed that information necessary for estimating the demixing matrix is hard to obtain, and the number of times of update may be reduced or the update is stopped.

Furthermore, the calculation time at each update may be reduced by changing the inverse matrix calculation for the $W(\omega)$ and the $V_k(\omega)$ included in the updating of the demixing matrix of Expression (14) in the following manner.

First, when the inverse matrix of the $W(\omega)$ is given as $Z(\omega)=W^{-1}(\omega)$, if the $w_k^{(n-1)}(\omega)$ is updated to $w_k^{(n)}(\omega)$ at the time of previous update of the $W(\omega)$, and $\Delta w_k=w_k^{(n)}(\omega)-w_k^{(n-1)}(\omega)$ is given (the superscript in parentheses of each symbol indicates the number of times of update of the demixing matrix W), the following Expression (20) may be obtained. The $\Delta w_k$ corresponds to the amount of update of the demixing matrix. In Expression (20), $\omega$ is omitted.

$$W^{(n+1)} \leftarrow W^{(n)} + e_k \Delta w_k^H \tag{20}$$

When applying a mathematical theorem of matrix inversion lemma indicated in the following Equation (21) to Expression (20), an inverse matrix Z of an updated W may be sequentially calculated from the inverse matrix Z of the W before update, as indicated in Expression (22). The A in Equation (21) is a K×K-dimensional square matrix, the B is a K×L-dimensional matrix, and the C is an L×K-dimensional matrix. The I represents an identity matrix.

$$(A+BC)^{-1} = A^{-1} - A^{-1}B(I + CA^{-1}B)^{-1}CA^{-1} \tag{21}$$

$$z^{(n+1)} \leftarrow z^{(n)} - \frac{z^{(n)} e_k \Delta w_k^H z^{(n)}}{1 + \Delta w_k^H Z^{(n)} e_k} \tag{22}$$

Also, in the case of calculating $V_k(t+1)$ using Equation (17), its inverse matrix $U_k(t+1)$ is calculated in the manner of the following Equation (23) using $U_k(t)$ of an immediately preceding time point.

$$U_k(t+1) = \frac{1}{\alpha} U_k(t) - \frac{1}{\alpha^2} \cdot \frac{p_k(t+1) U_k(t) x(t+1) x(t+1)^H U_k^H(t)}{1 + \alpha^{-1} p_k(t+1) x(t+1)^H U_k(t) x(t+1)} \tag{23}$$

Note that the $p_k(t+1)$ is expressed by the following Equation (24).

$$p_k(t+1) = (1-\alpha) \frac{G'(r_k(t+1))}{r_k(t+1)} \tag{24}$$

Equation (23) is obtained in the same manner as Expression (22) by applying the inverse matrix lemma of Equation (21) to Equation (17). The first update equation for the demixing matrix of Expression (14) may be rewritten in the manner of the following Expression (25) by the Z and the $U_k$ obtained by Expression (22) and Equation (23).

$$W_k(\omega) \leftarrow U_k(\omega) Z(\omega) e_k \tag{25}$$

Speeding up of calculation of the inverse matrix is difficult compared with calculation of the product and the sum of the matrices. Thus, a change is made such that each inverse matrix is sequentially calculated using Expression (22) and Equation (23). This enables the inverse matrix calculation to be replaced by the calculation of the product and the sum of the matrices, and as a result, the speed of the demixing matrix update processing may be drastically increased. Additionally, since the denominators of the second term on the right-hand side of Expression (22) and Equation (23) are scalars, calculation of an inverse matrix is not performed in Expression (22) and Equation (23).

Heretofore, the time-series signal separation method of the present embodiment has been described using calculation equations. Next, a concrete configuration of a signal processing apparatus of the present embodiment will be described with reference to the drawings.

FIG. 1 is a block diagram illustrating an example configuration of a signal processing apparatus 100 of the present embodiment. The signal processing apparatus 100 includes a receiving unit 101, a generation unit 111, an estimation unit 112, an updating unit 113, and a storage unit 121.

The receiving unit 101 receives input of an observation signal (an input signal) which is the target of signal processing. For example, the receiving unit 101 receives input of observation signals in M time-series at the current time point among M time series obtained by a signal observation apparatus outside the signal processing apparatus 100.

The generation unit 111 generates a separated signal by applying a demixing matrix to an observation signal which has been input. For example, the generation unit 111 applies a demixing matrix $W(\omega)$ updated by the updating unit 113 to an input observation signal $x(\omega,t)$ in the manner of Equation (2), and generates a separated signal $y(\omega,t)$ at the current time point.

The estimation unit 112 estimates, using an auxiliary variable estimated with respect to an observation signal in a certain section (a first section) using an auxiliary function and an observation signal in a second section different from the first section, an auxiliary variable in the second section. For example, the estimation unit 112 refers to an auxiliary variable estimated from a past observation signal (the first section), the observation signal at the current time point (the second section), and the value of the demixing matrix at the current time point, and estimates the value of the auxiliary variable at the current time point by Equation (17) or Equation (19). Additionally, in the case the updating unit 113 uses Expression (25) instead of Expression (14), the estimation unit 112 calculates Equation (23) and calculates the inverse matrix of the auxiliary variable.

The updating unit 113 updates the demixing matrix such that the function value of the auxiliary function is minimized based on the estimated auxiliary variable and the demixing matrix. For example, the updating unit 113 updates the demixing matrix at the current time point by referring to the auxiliary variable estimated by the estimation unit 112 and the demixing matrix using Expression (14). In the case Expression (25) is used instead of the first equation of Expression (14), the updating unit 113 calculates the inverse matrix of the demixing matrix at that point by Expression (22) before calculating Expression (25).

The storage unit 121 stores various types of data to be used in signal processing. For example, the storage unit 121 stores an auxiliary variable estimated in the past. As described above, the auxiliary variable estimated in the past is referred to at the time of the estimation unit 112 estimating the auxiliary variable at the current time point.

The receiving unit 101, the generation unit 111, the estimation unit 112, and the updating unit 113 may be realized by a processing device such as a CPU (Central Processing Unit) executing a program, that is, they may be realized by software, or they may be realized by hardware such as an IC (Integrated Circuit) or by a combination of software and hardware, for example.

Also, the storage unit 121 may be configured from any storage medium that is generally used, such as a HDD (Hard Disk Drive), an optical disk, a memory card, a RAM (Random Access Memory) or the like.

Figure 2:
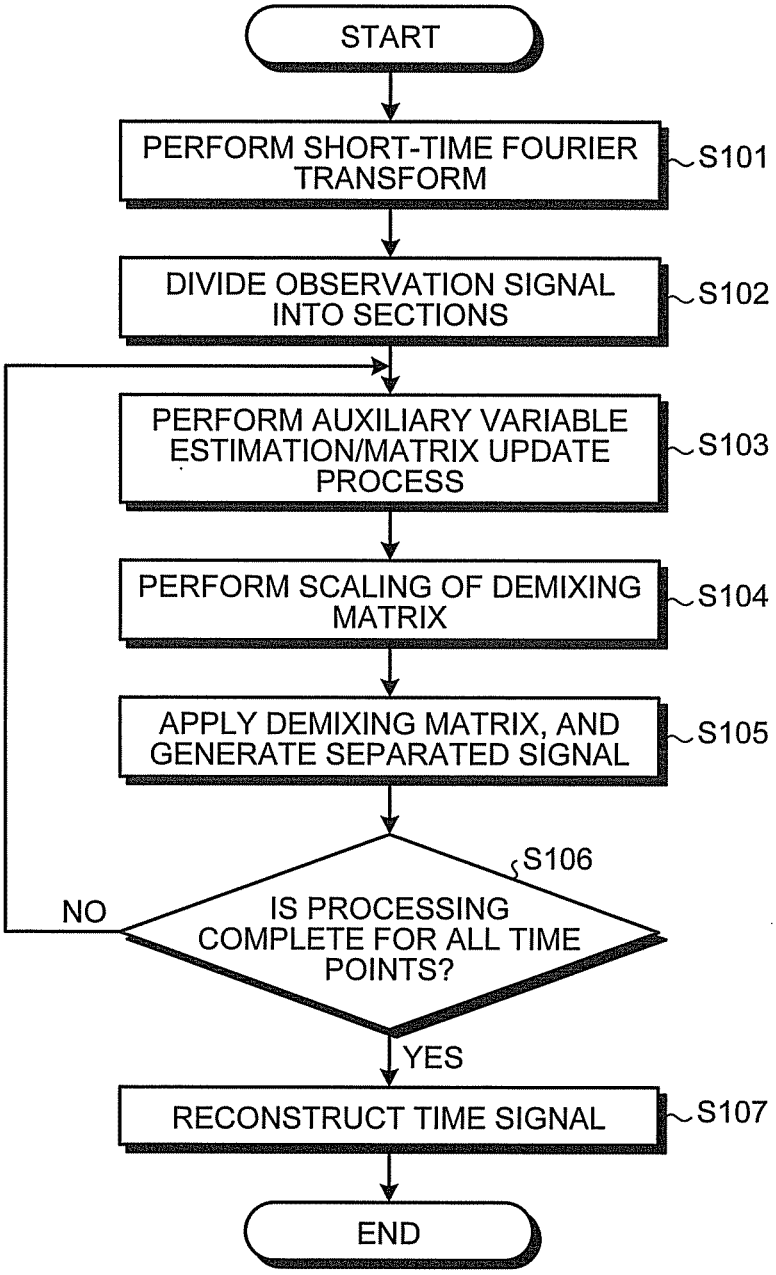
FIG. 2 is a flow chart of signal processing of the present embodiment.

Next, signal processing by the signal processing apparatus 100 of the present embodiment configured as above will be described with reference to FIG. 2. FIG. 2 is a flow chart illustrating an example of signal processing of the present embodiment.

For example, the signal processing of FIG. 2 is started when the receiving unit 101 receives a plurality of A/D (analog-to-digital) converted time-series digital acoustic signals (observation signals) observed by M microphones.

In the case of separating the acoustic signals (the observation signals) in the time-frequency representation, for example, the receiving unit 101 performs short-time Fourier transform for each of M time series (step S101). Also, the receiving unit 101 divides an observation signal in the time-frequency representation that is obtained by the short-time Fourier transform into a plurality of sections (step S102). When simplified, up to one time point in the result of the short-time Fourier transform is taken as one temporal section, and an M-dimensional vector as the $x(\omega,t)$ of Equation (3) is taken as an observation signal in one section. The dividing method for the temporal section is not limited to the above, and one temporal section may be a signal vector sequence formed from a plurality of time points, for example. Processing of steps S103 to S106 is sequentially performed for each section obtained by the dividing.

In step S103, an auxiliary variable estimation/matrix update process is performed by the estimation unit 112 and the updating unit 113 (details will be given later). The auxiliary variable at the current time point is thereby estimated, and the demixing matrix is updated using the estimated auxiliary variable.

The generation unit 111 performs scaling of the updated demixing matrix (step S104). With the demixing matrix updated in step S103, since the scale of amplitude with respect to an observation signal is different at each frequency, processing of making the scales identical is performed in step S104. Specifically, when a demixing matrix $W(\omega)$ at a frequency $\omega$ is obtained in step S103, the $W(\omega)$ is updated in the manner of the following Expression (26).

$$W(\omega) \leftarrow \mathrm{diag}(W^{-1}(\omega))W(\omega) \tag{26}$$

Here, the diag(A) represents a function that makes the non-diagonal elements of matrix A zero. At this time, if the $Z(\omega)$ in Equation (23) is calculated in step S103, the value may be used as it is instead of performing the inverse matrix calculation for the $W(\omega)$ in the above equation. This may reduce the amount of calculation.

The generation unit 111 generates a separated signal from the observation signal by applying the demixing matrix obtained in step S104 to the observation signal in the manner of Equation (2) (step S105).

The generation unit 111 determines whether the processing is finished for the observation signals at all time points which are the targets of processing (step S106). In the case the processing is not finished (step S106: No), the process is repeated from step S103. In the case it is finished (step S106: Yes), processing of step S107 is performed.

The separated signal obtained in step S105 is a time-frequency signal based on the short time Fourier transform, and therefore the generation unit 111 converts the same into a time-series acoustic signal as necessary by an overlap-add method or the like (step S107). Additionally, if only the time-frequency signal is necessary for the purpose of application to speech recognition or the like, step S107 may be omitted.

Figure 3:
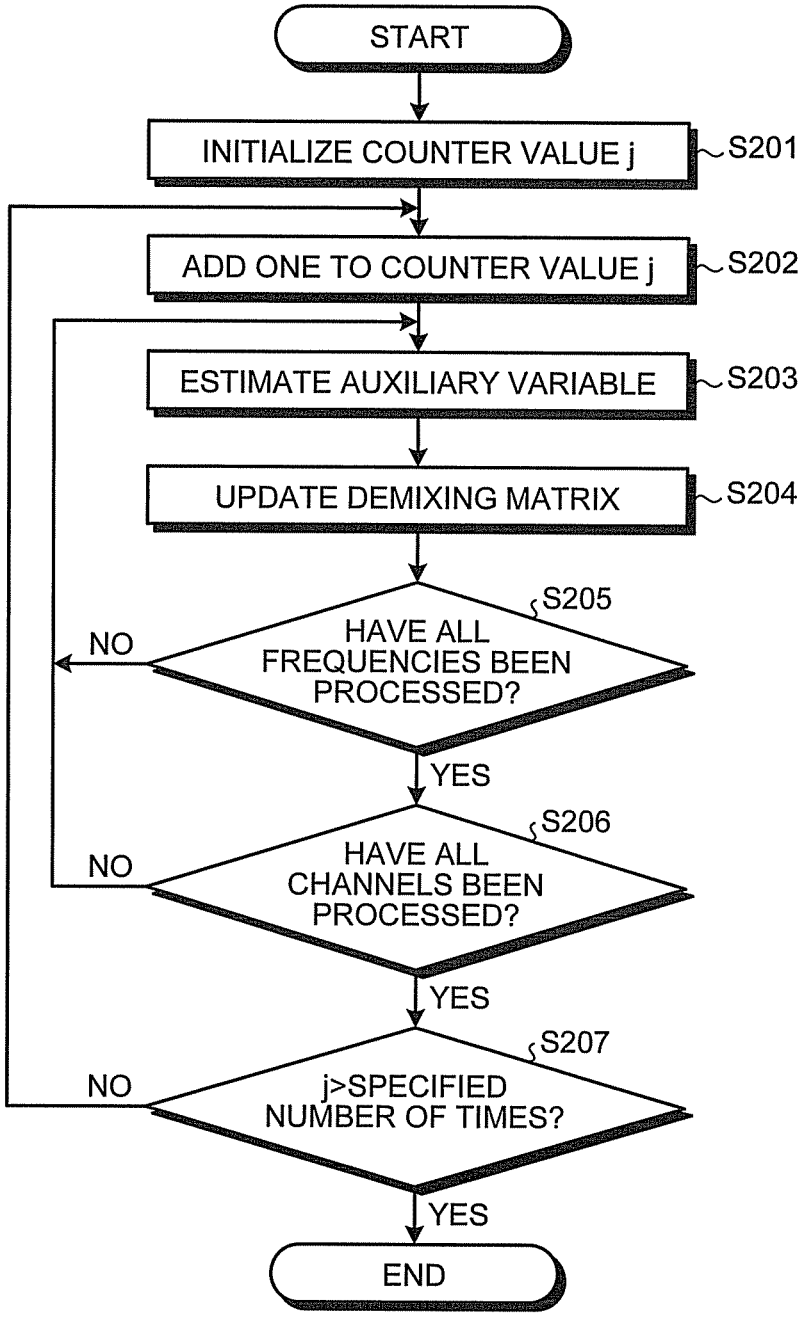
FIG. 3 is a flow chart of an auxiliary variable estimation/matrix update process of the present embodiment.

FIG. 3 is a flow chart illustrating an example of the auxiliary variable estimation/matrix update process of step S103.

The processing illustrated in FIG. 3 is performed with respect to the observation signal at the current time point. The estimation unit 112 or the updating unit 113 initializes a counter value j for counting the number of processing times of the present processing (the number of times of update) (step S201). The estimation unit 112 or the updating unit 113 adds one to the counter value j (step S202).

The estimation unit 112 takes an unprocessed channel, among K channels (separate channels) of the observation signal, as the processing target. The order of processing of the channels is arbitrary. Then, the estimation unit 112 estimates, with respect to an unprocessed frequency $\omega(1 \le \omega \le N_\omega)$ of a processing target channel k $(1 \le k \le K)$, the value of the auxiliary variable at the current time point by referring to an auxiliary variable estimated from a past observation signal, the observation signal at the current time point, and the demixing matrix at the current time point (step S203).

The updating unit 113 updates the demixing matrix such that the function value of the auxiliary function is minimized, using the estimated auxiliary variable and the demixing matrix (step S204).

The estimation unit 112 or the updating unit 113 determines whether all the frequencies have been processed or not (step S205). In the case not all the frequencies have been processed (step S205: No), the process is repeated from step S203 for the next unprocessed frequency. Additionally, regarding processing of a certain channel, since there is no dependency relationship between the frequencies $\omega$, calculation may be performed in parallel so as to reduce the calculation time.

In the case all the frequencies have been processed (step S205: Yes), the estimation unit 112 or the updating unit 113 determines whether all the channels have been processed or not (step S206). In the case not all the channels have been processed (step S206: No), the process is repeated for the next unprocessed channel from step S203. In the case all the channels have been processed (step S206: Yes), the estimation unit 112 or the updating unit 113 determines whether the counter value j is greater than a specified number of times or not (step S207). In the case the counter value j is not greater than the specified number of times (step S207: No), the process is repeated from step S202. In the case the counter value j is greater than the specified number of times (step S207: Yes), the auxiliary variable estimation/matrix update process is ended.

Additionally, the specified number of times may be a fixed value, or it may be changed for each time point according to a rule set in advance as described above.

As described above, the signal processing apparatus of the present embodiment is capable of reducing the amount of calculation of the online processing of the sound source separation process while maintaining the speed of following a change in the environment and the separation accuracy.

Figure 4:
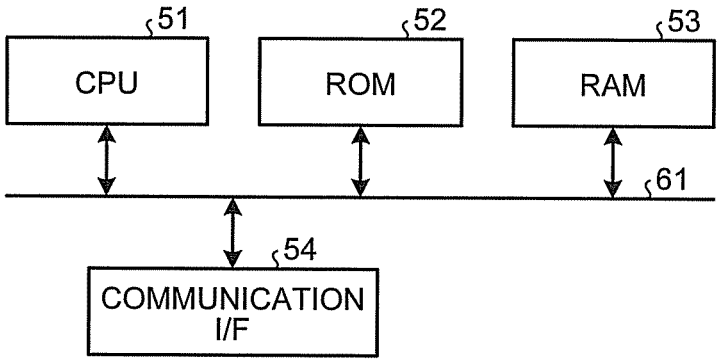
FIG. 4 is a hardware configuration diagram of the signal processing apparatus of the present embodiment.

Next, hardware configuration of the signal processing apparatus of the present embodiment will be described with reference to FIG. 4. FIG. 4 is an explanatory diagram illustrating a hardware configuration of the signal processing apparatus of the present embodiment.

The signal processing apparatus of the present embodiment includes a control device such as a CPU (Central Processing Unit) 51, a storage device such as a ROM (Read Only Memory) 52 or a RAM (Random Access Memory) 53, a communication I/F 54 for performing communication by connecting to a network, and a bus 61 connecting each units.

Programs to be executed by the signal processing apparatus of the present embodiment are provided being embedded in the ROM 52 or the like in advance, as a computer program product.

The programs to be executed by the signal processing apparatus of the present embodiment may be provided as a computer program product by being recorded, in a format of installable or executable files, in a computer-readable recording medium such as a CD-ROM (Compact Disk Read Only Memory), a flexible disk (FD), a CD-R (Compact Disk Recordable) or a DVD (Digital Versatile Disk).

Furthermore, the programs to be executed by the signal processing apparatus of the present embodiment may be stored in a computer connected to a network such as the Internet, and may be provided by being downloaded via the network. Also, the programs to be executed by the signal processing apparatus of the present embodiment may be provided or distributed as a computer program product via a network such as the Internet.

The programs to be executed by the signal processing apparatus of the present embodiment may cause a computer to function as each unit of the signal processing apparatus described above. According to this computer, the CPU 51 may read the programs from a computer-readable storage medium into a main storage device and perform execution.

While certain embodiments have been described, these embodiments have been presented by way of example only, and are not intended to limit the scope of the inventions. Indeed, the novel: embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A signal processing apparatus comprising:

an estimation unit configured to estimate an auxiliary variable of a processing target section including a first section of an input signal where a time length is not zero and a second section different from the first section by using an approximating auxiliary function for approximating an auxiliary function which has an auxiliary variable as an argument, the auxiliary function being determined according to an objective function that outputs a function value that is smaller as a statistical independence of a plurality of separated signals into which a plurality of input signals in time-series are separated by a demixing matrix is higher, the auxiliary function being capable of calculating the demixing matrix that reduces a function value of the objective function by alternately performing minimization of a function value regarding the auxiliary variable and minimization of a function value regarding the demixing matrix, the estimation unit estimating a value of the auxiliary variable of the processing target section based on the auxiliary variable previously estimated using the input signal in the first section and the input signal in the second section, the processing target section being a section to which the minimization of the function value regarding the auxiliary variable or the minimization of the function value regarding the demixing matrix is performed;

an updating unit configured to update the demixing matrix such that a function value of the approximating auxiliary function is minimized based on the value of the estimated auxiliary variable and the demixing matrix; and a generation unit configured to generate the separated signals by separating the input signals using the updated demixing matrix, wherein the input signals are signals that are sequentially input, the first section is a section including the input signal which is input in advance, and the second section is a section including the input signal which is currently input.

2. The apparatus according to claim 1, wherein the updating unit calculates an inverse matrix of the demixing matrix to be used at a time of updating the demixing matrix in a first step, based on an inverse matrix of the demixing matrix updated in a second step before the first step and an amount of update of the demixing matrix updated in the second step.

3. The apparatus according to claim 1, wherein the estimation unit estimates the value of the auxiliary variable of the processing target section by a weighted sum of a value of the auxiliary variable estimated for the input signal in the first section and a value of the auxiliary variable obtained from the input signal in the second section according to the auxiliary function.

4. The apparatus according to claim 1, wherein the updating unit calculates an inverse matrix of the auxiliary variable to be used at a time of updating the demixing matrix at a first time point, based on an inverse matrix of the auxiliary variable updated at a second time point before the first time point and the input signal at the first time point.

5. The apparatus according to claim 1, wherein the estimation unit changes an estimation method for the auxiliary variable according to attribute information indicating an attribute of the input signal.

6. The apparatus according to claim 5, wherein the estimation unit estimates the value of the auxiliary variable of the target processing section by using a weighted sum of a value of the auxiliary variable estimated for the input signal in the first section and a value of the auxiliary variable obtained from the input signal in the second section according to the auxiliary function, and changes a weight of the weighted sum according to the attribute information.

7. The apparatus according to claim 5, wherein the input signal is an acoustic signal output from a sound source, and the attribute information is a position of the sound source.

8. The apparatus according to claim 1, wherein the updating unit changes an update method for the demixing matrix according to attribute information indicating an attribute of the input signal.

9. The apparatus according to claim 8, wherein the attribute information is a power value of the input signal.

10. The apparatus according to claim 1, wherein the updating unit updates the demixing matrix until an amount of update of the demixing matrix after update with respect to the demixing matrix before update is smaller than a threshold value.

11. The apparatus according to claim 1, wherein estimation of the auxiliary variable by the estimation unit and update of the demixing matrix by the updating unit are repeatedly performed, and the generation unit generates the separated signals by separating the input signals using the demixing matrix after repetitive performance.

12. A signal processing method comprising:

estimating an auxiliary variable of a processing target section including a first section of an input signal where a time length is not zero and a second section different from the first section by using an approximating auxiliary function for approximating an auxiliary function which has an auxiliary variable as an argument, the auxiliary function being determined according to an objective function that outputs a function value that is smaller as a statistical independence of a plurality of separated signals into which a plurality of input signals in time-series are separated by a demixing matrix is higher, the auxiliary function being capable of calculating the demixing matrix that reduces a function value of the objective function by alternately performing minimization of a function value regarding the auxiliary variable and minimization of a function value regarding the demixing matrix, the estimating including estimating a value of the auxiliary variable of the processing target section based on the auxiliary variable previously estimated using the input signal in the first section and the input signal in the second section, the processing target section being a section to which the minimization of the function value regarding the auxiliary variable or the minimization of the function value regarding the demixing matrix is performed;

updating the demixing matrix such that a function value of the approximating auxiliary function is minimized based on the value of the estimated auxiliary variable and the demixing matrix; and generating the separated signals by separating the input signals using the updated demixing matrix, wherein the input signals are signals that are sequentially input, the first section is a section including the input signal which is input in advance, and the second section is a section including the input signal which is currently input.

13. A computer program product comprising a non-transitory computer-readable medium containing a program executed by a computer, the program causing the computer to execute:

estimating an auxiliary variable of a processing target section including a first section of an input signal where a time length is not zero and a second section different from the first section by using an approximating auxiliary function for approximating an auxiliary function which has an auxiliary variable as an argument, the auxiliary function being determined according to an objective function that outputs a function value that is smaller as a statistical independence of a plurality of separated signals into which a plurality of input signals in time-series are separated by a demixing matrix is higher, the auxiliary function being capable of calculating the demixing matrix that reduces a function value of the objective function by alternately performing minimization of a function value regarding the auxiliary variable and minimization of a function value regarding the demixing matrix, the estimating including estimating a value of the auxiliary variable of the processing target section based on the auxiliary variable previously estimated using the input signal in the first section and the input signal in the second section, the processing target section being a section to which the minimization of the function value regarding the auxiliary variable or the minimization of the function value regarding the demixing matrix is performed;

updating the demixing matrix such that a function value of the approximating auxiliary function is minimized based on the value of the estimated auxiliary variable and the demixing matrix; and generating the separated signals by separating the input signals using the updated demixing matrix, wherein the input signals are signals that are sequentially input, the first section is a section including the input signal which is input in advance, and the second section is a section including the input signal which is currently input.

* * * * *